US009005725B1

(12) United States Patent
Simpson et al.

(10) Patent No.: US 9,005,725 B1
(45) Date of Patent: Apr. 14, 2015

(54) TRANSPARENT INK-JET RECORDING FILMS, COMPOSITIONS, AND METHODS

(71) Applicant: Carestream Health, Inc., Rochester, NY (US)

(72) Inventors: Sharon M. Simpson, Lake Elmo, MN (US); William D. Devine, Fort Collins, MN (US); William J. Ruzinsky, Loveland, CO (US)

(73) Assignee: Carestream Health, Inc., Rochester, NY (US)

( * ) Notice: Subject to any disclaimer, the term of this patent is extended or adjusted under 35 U.S.C. 154(b) by 0 days.

(21) Appl. No.: 14/600,159

(22) Filed: Jan. 20, 2015

Related U.S. Application Data

(63) Continuation of application No. 13/205,660, filed on Aug. 9, 2011, now Pat. No. 8,974,878.

(60) Provisional application No. 61/381,469, filed on Sep. 10, 2010.

(51) Int. Cl.
*B41M 5/00* (2006.01)
*B41M 5/50* (2006.01)
*B41M 5/52* (2006.01)

(52) U.S. Cl.
CPC ..... *B41M 5/508* (2013.01); *B41M 5/506* (2013.01); *B41M 5/5218* (2013.01); *B41M 5/5227* (2013.01); *B41M 5/5254* (2013.01); *B41M 5/5236* (2013.01); *B41M 2205/38* (2013.01)

(58) Field of Classification Search
CPC ..... B41M 5/506; B41M 5/502; B41M 5/508; B41M 5/52; B41M 5/5218; B41M 5/5227; B41M 5/5236; B41M 5/5254
USPC ..... 428/32.24, 32.25, 32.26, 32.27, 32.28, 428/32.31, 32.34
See application file for complete search history.

(56) References Cited

U.S. PATENT DOCUMENTS

| | | | | |
|---|---|---|---|---|
| 4,365,423 | A | 12/1982 | Arter et al. | |
| 5,523,819 | A | 6/1996 | Frick | |
| 5,795,708 | A | 8/1998 | Boutet | |
| 6,387,473 | B1 * | 5/2002 | Sismondi et al. | 428/32.34 |
| 6,623,819 | B2 | 9/2003 | Missell et al. | |
| 6,630,283 | B1 | 10/2003 | Simpson et al. | |
| 6,908,191 | B2 | 6/2005 | Liu et al. | |
| 8,470,415 | B2 | 6/2013 | Simpson et al. | |
| 8,481,132 | B2 | 7/2013 | Simpson et al. | |
| 8,557,354 | B2 | 10/2013 | Simpson et al. | |
| 2001/0014381 | A1 * | 8/2001 | Kaneko et al. | 428/195 |
| 2003/0064208 | A1 | 4/2003 | Yamada et al. | |
| 2007/0231510 | A1 * | 10/2007 | Baker | 428/32.28 |
| 2008/0057232 | A1 * | 3/2008 | Leon et al. | 428/32.24 |

FOREIGN PATENT DOCUMENTS

WO WO 03/091038 11/2003

OTHER PUBLICATIONS

Sah, R.N. and Brown, P.H, "Boron Determination—A Review of Analytical Methods," *Microchemical J.*, 56, pp. 285-304 (1997).
Commonly assigned—U.S. Appl. No. 13/176,788, "Transparent Ink-Jet Recording Film," by Simpson et al., filed Jul. 6, 2011.
*Research Disclosure*, No. 308119, Dec. 1989, pp. 46, (available from Research Disclosure, 145 Main St., Ossining, NY, 10562.
International Search Report, dated Oct. 25, 2011 for International application No. PCT/US2011/047823, 2 pages.

* cited by examiner

*Primary Examiner* — Betelhem Shewareged
(74) *Attorney, Agent, or Firm* — Reed L. Christiansen

(57) ABSTRACT

Transparent ink-jet recording films, compositions, and methods are disclosed. Such films do not exhibit excessive ink drying times. These films exhibit high maximum optical densities and have low haze values. These films are useful for medical imaging.

17 Claims, No Drawings

TRANSPARENT INK-JET RECORDING FILMS, COMPOSITIONS, AND METHODS

CROSS REFERENCE TO RELATED APPLICATIONS

This application is a continuation of U.S. application Ser. No. 13/205,660, filed Aug. 9, 2011, entitled TRANSPARENT INK-JET RECORDING FILMS, COMPOSITIONS, AND METHODS, which claimed the benefit of U.S. Provisional Application No. 61/381,469, filed Sep. 10, 2010, entitled TRANSPARENT INK-JET RECORDING FILMS, COMPOSITIONS, AND METHODS, both of which are hereby incorporated by reference in their entirety.

SUMMARY

Transparent ink-jet recording films often employ one or more image-receiving layers on one or both sides of a transparent support. In order to obtain high image densities when printing on transparent films, more ink is often applied than is required for opaque films. However, use of more ink can increase ink drying times, impacting ink-jet printer throughput. The compositions and methods of the present application can provide transparent ink-jet recording films that do not exhibit excessive ink drying times. Such films can exhibit high maximum optical densities and low haze values.

U.S. Pat. No. 6,908,191 to Liu et al. and U.S. Pat. No. 5,523,819 to Frick, both of which are hereby incorporated by reference in their entirety, disclose and claim methods and compositions for transparent ink-jet recording films. Liu et al. disclose that ink-jet media employing subbing layers comprising a sulfonated polyester binder exhibit better performance than those employing subbing layers comprising a poly(vinyl alcohol) binder. The examples of Missell et al. also employ subbing layers comprising a sulfonated polyester binder. Surprisingly, the Applicants have discovered that the compositions and methods of the present application can provide ink-jet media employing under-layers comprising gelatin that perform better than ink-jet media employing under-layers comprising either sulfonated polyesters or poly (vinyl alcohol).

At least one embodiment provides a transparent ink-jet recording film comprising a substrate, at least one under-layer disposed on the substrate, and at least one image-receiving layer disposed on the at least one under-layer. Such a substrate may, for example, comprise a transparent substrate. The under-layer may comprise gelatin and at least one borate or borate derivative. In some embodiments the at least one borate or borate derivative may comprise at least one hydrate of sodium tetraborate, such as, for example sodium tetraborate decahydrate (borax). In some embodiments, the at least one under-layer may comprise at least about 0.10 g/m$^2$ boron atoms on a dry coating basis, or at least about 0.14 g/m$^2$ boron atoms on a dry coating basis, or at least about 0.16 g/m$^2$ boron atoms on a dry coating basis, or from about 0.16 g/m$^2$ to about 0.21 g/m$^2$ boron atoms on a dry coating basis, or at least about 0.19 g/m$^2$ boron atoms on a dry coating basis, or from about 0.19 g/m$^2$ to about 0.21 g/m$^2$ boron atoms on a dry coating basis. In some embodiments, the under-layer coating may comprise a dry coating weight of at least about 4.3 g/m$^2$, or at least about 4.5 g/m$^2$.

The image-receiving layer may comprise at least one water soluble or water dispersible polymer, at least one inorganic particle, and nitric acid. In some embodiments, the at least one water soluble or water dispersible polymer may comprise poly(vinyl alcohol). In some embodiments, the at least one inorganic particle may comprise boehmite alumina. In some embodiments, the image-receiving layer may comprise a dry coating weight of at least about 40 g/m$^2$ on a dry basis, or at least about 41.3 g/m$^2$ on a dry basis, or at least about 45 g/m$^2$ on a dry basis, or at least about 46 g/m$^2$ on a dry basis, or at least about 49 g m$^2$ on a dry basis. In some embodiments, the image-receiving layer may further comprise a surfactant, such as, for example, nonyl phenol, glycidyl polyether. In at least some embodiments, such transparent ink-jet recording films exhibit no visually discernable impingement patterning or mud-cracking, even in cases where the image-receiving layer comprises a dry coating weight of at least about 46 g/m$^2$. Such recording films may exhibit exceptional drying performance, such as, for example, exhibiting no ink puddling when imaged with an EPSON® 7900 ink-jet printer at optical densities of at least 2.8, or exhibiting percent wetness below about 25% when imaged at 57-58% relative humidity with an EPSON® 7900 ink-jet printer at optical densities of at least 3.0, or exhibiting wetness values below about 0.50 when imaged at 86% relative humidity with an EPSON® 4900 ink-jet printer at optical densities of at least 2.8, or exhibiting wetness values below about 0.25 when imaged at 73% relative humidity with an EPSON® 4900 ink-jet printer at optical densities of at least 2.8.

These embodiments and other variations and modifications may be better understood from the detailed description, exemplary embodiments, examples, and claims that follow. Any embodiments provided are given only by way of illustrative example. Other desirable objectives and advantages inherently achieved may occur or become apparent to those skilled in the art. The invention is defined by the appended claims.

DETAILED DESCRIPTION

All publications, patents, and patent documents referred to in this document are incorporated by reference herein in their entirety, as though individually incorporated by reference.

U.S. application Ser. No. 13/205,660, filed Aug. 9, 2011, is hereby incorporated by reference in its entirety. U.S. Provisional Application No. 61/381,469, filed Sep. 10, 2010, is hereby incorporated by reference in its entirety.

Introduction

An ink-jet recording film may comprise at least one image-receiving layer, which receives ink from an ink-jet printer during printing, and a substrate or support, which may be opaque or transparent. An opaque support may be used in films that may be viewed using light reflected by a reflective backing, while a transparent support may be used in films that may be viewed using light transmitted through the film.

Some medical imaging applications require high image densities. For a reflective film, high image densities may be achieved by virtue of the light being absorbed on both its path into the imaged film and again on the light's path back out of the imaged film from the reflective backing. On the other hand, for a transparent film, because of the lack of a reflective backing, achievement of high image densities may require application of larger quantities of ink than are common for opaque films.

Transparent Ink-Jet Films

Transparent ink-jet recording films are known in the art. See, for example, U.S. Pat. No. 8,470,415, granted on Jun. 25, 2013, "TRANSPARENT INK-JET RECORDING FILM," by Simpson et al., filed Jul. 6, 2011, and U.S. provisional patent application 61/375,325, "SMUDGE RESISTANCE OF MATTE BLANK INKS AND DRYING OF INKS USING A 2-LAYER INKJET RECEPTOR CONTAINING A MONOSACCHARIDE OR DISACCHARIDE ON A TRANSPARENT SUPPORT," by Simpson et al., filed Aug. 20, 2010, both of which are hereby incorporated by reference in their entirety.

Transparent ink-jet recording films may comprise one or more transparent substrates upon which at least one under-layer may be coated. Such an under-layer may optionally be dried before being further processed. The film may further comprise one or more image-receiving layers coated upon at least one under-layer. Such an image-receiving layer is generally dried after coating. The film may optionally further comprise additional layers, such as one or more backing layers or overcoat layers, as will be understood by those skilled in the art.

One performance characteristic of transparent ink-jet recording films is the presence or absence of "mud cracking." A film that exhibits mud-cracking has a surface with fine cracks that resemble a dry creek bed. Such mud-cracking on a film's surface can impact the quality of the rendered image. An observer may qualitatively assess the visual severity of mud-cracking exhibited by transparent ink-jet films, so their relative quality may be ranked.

Another performance characteristic of transparent ink-jet recording films is the presence or absence of "impingement patterns." Such patterns may be produced during the drying operations of the film manufacture process, particularly when attempting to manufacture films with thick coatings, where large quantities of water or organic solvents must be removed. The compositions and methods of the present application can reduce or eliminate such patterning without requiring reduced process throughput.

Under-Layer Coating Mix

Under-layers may be formed by applying at least one under-layer coating mix to one or more transparent substrates. The under-layer formed may, in some cases, comprise at least about 2.9 g/m$^2$ solids on a dry basis, or at least about 3.0 g/m$^2$ solids on a dry basis, or at least about 3.5 g/m$^2$ solids on a dry basis, or at least about 4.0 g/m$^2$ solids on a dry basis, or at least about 4.2 g/m$^2$ solids on a dry basis, or at least about 5.0 g/m$^2$ solids on a dry basis, or at least about 5.4 g/m$^2$ solids on a dry basis, or at least about 5.8 g/m$^2$ solids on a dry basis. The under-layer coating mix may comprise gelatin. In at least some embodiments, the gelatin may be a Regular Type IV bovine gelatin. The under-layer coating mix may further comprise at least one borate or borate derivative, such as, for example, sodium borate, sodium tetraborate, sodium tetraborate decahydrate, boric acid, phenyl boronic acid, butyl boronic acid, and the like. More than one type of borate or borate derivative may optionally be included in the under-layer coating mix. In some embodiments, the borate or borate derivative may be used in an amount of up to, for example, about 2 g/m$^2$. In at least some embodiments, the ratio of the at least one borate or borate derivative to the gelatin may be between about 20:80 and about 1:1 by weight, or the ratio may be about 0.45:1 by weight. In some embodiments, the under-layer coating mix may comprise, for example, at least about 4 wt % solids, or at least about 9.2 wt % solids. The under-layer coating mix may comprise, for example, about 15 wt % solids.

The under-layer coating mix may also optionally comprise other components, such as surfactants, such as, for example, nonyl phenol, glycidyl polyether. In some embodiments, such a surfactant may be used in amount from about 0.001 to about 0.20 g/m$^2$, as measured in the under-layer. In some embodiments, the under-layer coating mix may optionally further comprise a thickener, such as, for example, a sulfonated polystyrene. These and other optional mix components will be understood by those skilled in the art.

Image-Receiving Layer Coating Mix

Image-receiving layers may be formed by applying at least one image-receiving layer coating mix to one or more under-layer coatings. The image-receiving layer formed may, in some cases, comprise at least about 40 g/m$^2$ solids on a dry basis, or at least about 41.3 g/m$^2$ solids on a dry basis, or at least about 45 g/m$^2$ solids on a dry basis, or at least about 49 g/m$^2$ solids on a dry basis. The image-receiving coating mix may comprise at least one water soluble or dispersible cross-linkable polymer comprising at least one hydroxyl group, such as, for example, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropylmethacrylate, hydroxy cellulose ethers, such as, for example, hydroxyethylcellulose, and the like. More than one type of water soluble or water dispersible cross-linkable polymer may optionally be included in the under-layer coating mix. In some embodiments, the at least one water soluble or water dispersible polymer may be used in an amount of up to about 1.0 to about 4.5 g/m$^2$, as measured in the image-receiving layer.

The image-receiving layer coating mix may also comprise at least one inorganic particle, such as, for example, metal oxides, hydrated metal oxides, boehmite alumina, clay, calcined clay, calcium carbonate, aluminosilicates, zeolites, barium sulfate, and the like. Non-limiting examples of inorganic particles include silica, alumina, zirconia, and titania. Other non-limiting examples of inorganic particles include fumed silica, fumed alumina, and colloidal silica. In some embodiments, fumed silica or fumed alumina have primary particle sizes up to about 50 nm in diameter, with aggregates being less than about 300 nm in diameter, for example, aggregates of about 160 nm in diameter. In some embodiments, colloidal silica or boehmite alumina have particle size less than about 15 nm in diameter, such as, for example, 14 nm in diameter. More than one type of inorganic particle may optionally be included in the image-receiving coating mix.

In at least some embodiments, the ratio of inorganic particles to polymer in the at least one image-receiving layer coating mix may be, for example, between about 88:12 and about 95:5 by weight, or the ratio may be about 92:8 by weight.

Image-receiving layer coating layer mixes prepared from alumina mixes with higher solids fractions can perform well in this application. However, high solids alumina mixes can, in general, become too viscous to be processed. It has been discovered that suitable alumina mixes can be prepared at, for example, 25 wt % or 30 wt % solids, where such mixes comprise alumina, nitric acid, and water, and where such mixes comprise a pH below about 3.09, or below about 2.73, or between about 2.17 and about 2.73. During preparation, such alumina mixes may optionally be heated, for example, to 80° C.

The image-receiving coating layer mix may also comprise one or more surfactants such as, for example, nonyl phenol, glycidyl polyether. In some embodiments, such a surfactant may be used in amount of, for example, about 1.5 g/m$^2$, as measured in the image-receiving layer. In some embodiments, the image-receiving coating layer may also optionally comprise one or more acids, such as, for example, nitric acid.

These and components may optionally be included in the image-receiving coating layer mix, as will be understood by those skilled in the art.

Transparent Substrate

Some embodiments provide transparent ink-jet films comprising transparent substrates. Such transparent substrates are generally capable of transmitting visible light without appreciable scattering or absorption. For example, such transparent substrates may allow transmission of at least about 80% of visible light, or of at least about 85% of visible light, or of at least about 90% of visible light, or of at least about 95% of visible light.

Transparent substrates may be flexible, transparent films made from polymeric materials, such as, for example, polyethylene terephthalate, polyethylene naphthalate, cellulose acetate, other cellulose esters, polyvinyl acetal, polyolefins, polycarbonates, polystyrenes, and the like. In some embodiments, polymeric materials exhibiting good dimensional stability may be used, such as, for example, polyethylene terephthalate, polyethylene naphthalate, other polyesters, or polycarbonates.

Other examples of transparent substrates are transparent, multilayer polymeric supports, such as those described in U.S. Pat. No. 6,630,283 to Simpson, et al., which is hereby incorporated by reference in its entirety. Still other examples of transparent supports are those comprising dichroic mirror layers, such as those described in U.S. Pat. No. 5,795,708 to Boutet, which is hereby incorporated by reference in its entirety.

Transparent substrates may optionally contain colorants, pigments, dyes, and the like, to provide various background colors and tones for the image. For example, a blue tinting dye is commonly used in some medical imaging applications. These and other components may optionally be included in the transparent substrate, as will be understood by those skilled in the art.

In some embodiments, the transparent substrate may be provided as a continuous or semi-continuous web, which travels past the various coating, drying, and cutting stations in a continuous or semi-continuous process.

Coating

The at least one under-layer and at least one image-receiving layer may be coated from mixes onto the transparent substrate. The various mixes may use the same or different solvents, such as, for example, water or organic solvents. Layers may be coated one at a time, or two or more layers may be coated simultaneously. For example, simultaneously with application of an under-layer coating mix to the support, an image-receiving layer may be applied to the wet under-layer using such methods as, for example, slide coating.

Layers may be coated using any suitable methods, including, for example, dip-coating, wound-wire rod coating, doctor blade coating, air knife coating, gravure roll coating, reverse-roll coating, slide coating, bead coating, extrusion coating, curtain coating, and the like. Examples of some coating methods are described in, for example, *Research Disclosure*, No. 308119, December 1989, pp. 1007-08, (available from Research Disclosure, 145 Main St., Ossining, N.Y., 10562, http://www.researchdisclosure.com).

Drying

Coated layers, such as, for example under-layers or image-receiving layers, may be dried using a variety of known methods. Examples of some drying methods are described in, for example, *Research Disclosure*, No. 308119, December 1989, pp. 1007-08, (available from Research Disclosure, 145 Main St., Ossining, N.Y., 10562, http://www.researchdisclosure.com). In some embodiments, coating layers may be dried as they travel past one or more perforated plates through which a gas, such as, for example, air or nitrogen, passes. Such an impingement air dryer is described in U.S. Pat. No. 4,365,423 to Arter et al., which is incorporated by reference in its entirety. The perforated plates in such a dryer may comprise perforations, such as, for example, holes, slots, nozzles, and the like. The flow rate of gas through the perforated plates may be indicated by the differential gas pressure across the plates. The ability of the gas to remove water may be limited by its dew point, while its ability to remove organic solvents may be limited by the amount of such solvents in the gas, as will be understood by those skilled in the art.

In some embodiments, the under-layer may be dried by exposure to ambient air. Image-receiving layers may be dried by exposure to air at, for example, 85 C for 10 min in a Blue M Oven.

Under-Layer Coating

The under-layer coating will generally comprise gelatin and at least one borate or borate derivative. In some embodiments, the at least one borate or borate derivative may comprise at least one hydrate of sodium tetraborate, such as, for example, sodium tetraborate decahydrate (borax), sodium tetraborate pentahydrate, sodium tetraborate tetrahydrate, and the like.

The under-layer coating will generally comprise boron atoms, at least some of which may be in the at least one borate or borate derivative. Boron atom concentrations in under-layer coatings may be determined by known analytical techniques, such as, for example, inductively-coupled mass spectrometry. Such analytical methods are described in, for example, Sah, R. N. and Brown, P. H, "Boron Determination—A Review of Analytical Methods," *Microchemical J.*, 56, 285-304 (1997), which is hereby incorporated by reference in its entirety. In some embodiments, under-layer coatings may comprise at least about 0.10 $g/m^2$ boron atoms on a dry coating basis, or at least about 0.16 $g/m^2$ boron atoms on a dry coating basis, or at least about 0.17 $g/m^2$ boron atoms on a dry coating basis, or from about 0.16 $g/m^2$ to about 0.21 $g/m^2$ boron atoms on a dry coating basis, or at least about 0.19 $g/m^2$ boron atoms on a dry coating basis, or from about 0.19 $g/m^2$ to about 0.21 $g/m^2$ boron atoms on a dry coating basis.

Exemplary Embodiments

U.S. Provisional Application No. 61/381,469, filed Sep. 10, 2010, which is hereby incorporated by reference in its entirety, disclosed the following ten non-limiting exemplary embodiments:

A. A transparent ink-jet recording film comprising:

a substrate;

at least one under-layer disposed on said substrate, said under-layer comprising gelatin and at least one borate or borate derivative, said at least one under-layer comprising at least about 0.1 $g/m^2$ boron atoms on a dry coating basis; and at least one image-receiving layer disposed on said at least one under-layer, said image-receiving layer comprising at least one water soluble or water dispersible polymer and at least one inorganic particle.

B. The transparent ink-jet recording film according to embodiment A, wherein said under-layer comprises at least about 0.19 $g/m^2$ boron atoms on a dry coating basis.

C. The transparent ink-jet recording film according to embodiment A, wherein said under-layer comprises from about 0.19 $g/m^2$ to about 0.21 $g/m^2$ boron atoms on a dry coating basis.

D. The transparent ink-jet recording film according to embodiment A, wherein said at least one under-layer comprises a dry coating weight of at least about 4.3 $g/m^2$.

E. The transparent ink-jet recording film according to embodiment A, wherein said at least one borate or borate derivative comprises at least one hydrate of sodium tetraborate.

F. The transparent ink-jet recording film according to embodiment A, wherein said at least one borate or borate derivative comprises sodium tetraborate decahydrate.

G. The transparent ink-jet recording film according to embodiment A, wherein said at least one water soluble or water dispersible polymer comprises poly(vinyl alcohol).

H. The transparent ink-jet recording film according to embodiment A, wherein said at least one inorganic particle comprises boehmite alumina.

I. The transparent ink-jet recording film according to embodiment A, wherein said image-receiving layer comprises a dry coating weight of at least about 46 g/m$^2$.

J. The transparent ink-jet recording film according to embodiment A, wherein said image-receiving layer further comprises at least one surfactant.

EXAMPLES

Materials

Materials used in the examples were available from Aldrich Chemical Co., Milwaukee, unless otherwise specified.

Boehmite is an aluminum oxide hydroxide (γ-AlO(OH)).

Borax is sodium tetraborate decahydrate.

CELVOL® 203 is a poly(vinyl alcohol) that is 87-89% hydrolyzed, with 13,000-23,000 weight-average molecular weight. It is available from Sekisui Specialty Chemicals America, LLC, Dallas, Tex.

CELVOL® 540 is a poly(vinyl alcohol) that is 87-89.9% hydrolyzed, with 140,000-186,000 weight-average molecular weight. It is available from Sekisui Specialty Chemicals America, LLC, Dallas, Tex.

DISPERAL® HP-14 is a dispersible boehmite alumina powder with high porosity and a particle size of 14 nm. It is available from Sasol North America, Inc., Houston, Tex.

EASTMAN AQ29® is an aqueous sulfonated polyester dispersion. It is available from Eastman Chemical Co., Kingsport, Tenn.

Gelatin is a Regular Type IV bovine gelatin. It is available as Catalog No. 8256786 from Eastman Gelatine Corporation, Peabody, Mass.

KATHON® LX is a microbiocide. It is available from Dow Chemical.

Surfactant 10G is an aqueous solution of nonyl phenol, glycidyl polyether. It is available from Dixie Chemical Co., Houston, Tex.

VERSA-TL® 502 is a sulfonated polystyrene (1,000,000 molecular weight). It is available from AkzoNobel.

Example 1 (Comparative)

Preparation of Gelatin Under-Layer Coating Mix

To a mixing vessel, 257.5 g of deionized water was introduced. 12.60 g of gelatin was added to the agitated vessel and allowed to swell. This mix was heated to 60° C. and held until the gelatin was fully dissolved. The mix was then cooled to 50° C. To this mix, 5.67 g of borax (sodium tetraborate decahydrate) was added and mixed until the borax was fully dissolved. To this mix, 19.69 g of an aqueous solution of 3.2 wt % sulfonated polystyrene (VERSA-TL® 502, AkzoNobel) and 0.2 wt % microbiocide (KATHON® LX, Dow) was added and mixed until homogeneous. The mix was then cooled to 40° C. 4.30 g of a 10 wt % aqueous solution of nonyl phenol, glycidyl polyether (Surfactant 10G) was then added and mixed until homogeneous. The mix temperature was maintained at 40° C. for coating.

Preparation of Under-Layer Coated Substrates

Blue 7 mil polyethylene terephthalate substrates were knife-coated at room temperature with the under-layer coating mix, using a wet coating gap of 3.5 mils. The under-layer coatings were dried at room temperature. The resulting under-layer coatings had 6.44 wt % solids and a weight ratio of borax to gelatin of 0.45:1. The dry under-layer coating weights were 3.8 g/m$^2$.

Preparation of Alumina Mix

A nominal 20 wt % alumina mix was prepared at room temperature by mixing 4.62 g of a 22 wt % aqueous solution of nitric acid and 555.38 g of deionized water. To this mix, 140 g of alumina powder (DISPERAL® HP-14) was added over 30 min. The pH of the mix was adjusted to 3.25 by adding additional nitric acid solution. The mix was heated to 80° C. and stirred for 30 min. The mix was cooled to room temperature and held for gas bubble disengagement prior to use.

Preparation of Image-Receiving Layer Coating Mix

An nominal 18 wt % solids image-receiving coating mix was prepared at room temperature by introducing 7.13 g of a 10 wt % aqueous solution of poly(vinyl alcohol) (CELVOL® 540) into a mixing vessel and agitating. To this mix, 41.00 g of the alumina mix and 0.66 g of a 10 wt % aqueous solution of nonyl phenol, glycidyl polyether (Surfactant 10G) was added. The mix was cooled to room temperature and held for gas bubble disengagement prior to use. The resulting image-receiving layer coating mix had an inorganic particle to polymer weight ratio of 92:8.

Preparation of Image-Receiving Layer Coated Films

The nominal 18 wt % solids image-receiving layer coating mix was knife-coated at room temperature onto three under-layer coated substrates, using a coating gap of 12 mils. The coated films were dried at 85° C. for 10 min in a Blue M Oven. The dry image-receiving layer coating weights were 44 g/m$^2$.

Evaluation of Samples

Coated films were printed and evaluated at 88-89% relative humidity. Coated films were imaged with an EPSON® 7900 ink-jet printer using a Wasatch Raster Image Processor (RIP). A grey scale image was created by a combination of photo black, light black, light light black, magenta, light magenta, cyan, light cyan, and yellow EPSON® inks that were supplied with the printer. Samples were printed with a 17-step grey scale wedge having a maximum optical density of at least 2.8.

Immediately after the film exited the printer, the ink-jet image was turned over and placed over a piece of white paper. The fraction of each wedge that was wet was recorded by sequential wedge number, with wedge 1 being the wedge having the maximum optical density and wedge 17 being the wedge with the minimum optical density. The percent of wet ink on the wedge having the maximum optical density is referred to as a "percent wetness" which has a value of 0 for a completely dry wedge and a value of 100 for a completely wet wedge. Results are summarized in Table I.

Example 2

The procedures of Example 1 were repeated for the case of a nominal 6.79 wt % solids under-layer coating mix with a weight ratio of borax to gelatin of 0.53:1. The under-layer coating mix preparation procedure was modified to use 256.70 g of deionized water and 6.72 g of borax (sodium tetraborate decahydrate). The remaining procedures were not modified. Two image-receiving layer coated films were prepared for evaluation.

The coated films were evaluated according to the method of Example 1. Results are summarized in Table I. These samples exhibited better ink drying than the samples of Example 1.

Example 3

The procedures of Example 1 were repeated for the case of a nominal 7.00 wt % solids under-layer coating mix with a weight ratio of borax to gelatin of 0.58:1. The under-layer coating mix preparation procedure was modified to use 256.07 g of deionized water and 7.35 g of borax (sodium tetraborate decahydrate). The remaining procedures were not modified. Two image-receiving layer coated films were prepared for evaluation.

The coated films were evaluated according to the method of Example 1. Results are summarized in Table I. These samples exhibited better ink drying performance than the samples of Example 1.

Example 4 (Comparative)

Example 1 was replicated. The coated films were evaluated according to the method of Example 1. Results are summarized in Table I.

Example 5

Example 2 was replicated. The coated films were evaluated according to the method of Example 1. Results are summarized in Table I. These samples exhibited better ink drying performance than the samples of Example 4.

Example 6

The procedures of Example 1 were repeated for the case of a nominal 7.14 wt % solids under-layer coating mix with a weight ratio of borax to gelatin of 0.62:1, by adjusting the relative amounts of deionized water and borax used. Blue 7 mil polyethylene terephthalate substrates were knife-coated at room temperature with the under-layer coating mix, using a wet gap of 3.5 mils (Samples 6-1 and 6-2) or 3.0 mils (Samples 6-3 and 6-4). The remaining procedures were not modified. Four image-receiving layer coated films were prepared for evaluation.

The coated films were evaluated according to the method of Example 1. Results are summarized in Table I. These samples exhibited better ink drying performance than the samples of Example 4.

Example 7

Preparation of Gelatin Under-Layer Coating Mix

To a mixing vessel, 170.43 g of deionized water was introduced. 8.40 g of gelatin was added to the agitated vessel and allowed to swell. This mix was heated to 60° C. and held until the gelatin was fully dissolved. The mix was then cooled to 50° C. To this mix, 5.18 g of borax (sodium tetraborate decahydrate) was added and mixed until the borax was fully dissolved. To this mix, 13.13 g of an aqueous solution of 3.2 wt % sulfonated polystyrene (VERSA-TL® 502, AkzoNobel) and 0.2 wt % microbiocide (KATHON® LX, Dow) was added and mixed until homogeneous. The mix was then cooled to 40° C. 2.86 g of a 10 wt % aqueous solution of nonyl phenol, glycidyl polyether (Surfactant 10G) was then added and mixed until homogeneous. This mix was cooled to room temperature and held to allow disengagement of any gas bubbles prior to use. The weight ratio of borax to gelatin in the resulting under-layer coating mix was 0.62:1.

Preparation of Under-Layer Coated Webs

The under-layer coating mix was heated to 40° C. and applied continuously to room temperature polyethylene terephthalate web, which were moving at a speed of 30.0 ft/min. The under-layer coating mix feed rate was 61.0 g/min. The coated webs were dried continuously by moving past perforated plates through which room temperature air flowed. The pressure drop across the perforated plates was in the range of 0.8 to 3 in $H_2O$. The air dew point was in the range of 7 to 13° C. The resulting dry under-layer coating weight was 4.3 g/m$^2$.

Preparation of Alumina Mix

An alumina mix was prepared at room temperature by mixing 166 g of a 22 wt % aqueous solution of nitric acid and 6059 g of deionized water. To this mix, 2075 g of alumina powder (DISPERAL® HP-14) was added over 30 min. The pH of the mix was adjusted to 2.56 by adding additional nitric acid solution. The mix was heated to 80° C. and stirred for 30 min. The mix was cooled to room temperature and held for gas bubble disengagement prior to use.

Preparation of Image-Receiving Layer Coating Mix

An image-receiving coating mix was prepared at room temperature by introducing 1756 g of a 10 wt % aqueous solution of poly(vinyl alcohol) (CELVOL® 540) into a mixing vessel and agitating. To this mix, 8080 g of the alumina mix and 162.6 g of a 10 wt % aqueous solution of nonyl phenol, glycidyl polyether (Surfactant 10G) was added. The mix was cooled to room temperature and held for gas bubble disengagement prior to use.

Preparation of Image-Receiving Layer Coated Films

The image-coating mix was heated to 40° C. and coated onto the under-layer coated surface of a room temperature polyethylene terephthalate web, which was moving at a speed of 30.0 ft/min. The image-receiving layer coating mix feed rate was 184.8 g/min. The coated films were dried continuously by moving past perforated plates through which room temperature air flowed. The pressure drop across the perforated plates was in the range of 0.8 to 3 in $H_2O$. The air dew point was in the range of 7 to 13° C. The resulting image-receiving layer coating weight was 46.1 g/m$^2$.

Evaluation of Samples

The coated film was evaluated according to the method of Example 1, using printing relative humidities of 86-88% (sample 7-1) and 57-58% (sample 7-2). Results are summarized in Table I.

Example 8 (Comparative)

The procedures of Example 7 were repeated, but using a decreased under-layer coating feed rate of 44.5 g/min. The resulting dry under-layer coating weight was 3.1 g/m$^2$. The coated film was evaluated according to the method of Example 1, using printing relative humidities of 86-88% (sample 8-1) and 57-58% (sample 8-2). Results are summarized in Table I. These samples exhibited poorer ink drying performance at 86-88% relative humidity than the samples of Example 7.

Example 9 (Comparative)

The procedures of Example 7 were repeated, but using a decreased weight ratio of borax to gelatin of 0.45:1. The under-layer coating mix preparation procedure was modified to use 171.83 g of deionized water and 3.78 g of borax (sodium tetraborate decahydrate). The remaining procedures were not modified. The resulting dry under-layer coating weight was 3.9 g/m$^2$. The coated film was evaluated according to the method of Example 1, using printing relative humidities of 86-88% (sample 9-1) and 57-58% (sample 9-2). Results are summarized in Table I. Drying performance at 87-88% relative humidity was poorer than that for the samples of Example 7 and similar to that for the samples of Example 8. Drying performance at 57-58% relative humidity was poor compared to the samples of both Examples 7 and 8.

For Examples 7-9, ranges of boron coverages in the dry under-layer coatings were estimated based on the amounts of borax fed, the target dry under-layer coating weights, and the measured dry under-layer coating weights. Upper estimates of boron coverage were calculated by assuming that the discrepancies between the target and actual under-layer coating weights were due to loss of some of the waters of hydration of the borax. Lower estimates of boron coverage were calculated by assuming that the discrepancies between the target and actual under-layer coating weights were due to errors in either the under-layer coating mix feed rate or the web speed or both. Table II summarizes under-layer coating weights, estimated boron coverages, and drying results from Experiments 7-9. At 86-88% relative humidity (samples 7-1, 8-1, 9-1), the sample with the higher borax coverage exhibited better ink drying performance than the samples with the lower borax coverage. At 57-58% relative humidity (samples 7-2, 8-2, 9-2), the sample with the poorest drying performance had the lower borax coverage.

TABLE I

| ID | UL Borax to Gelatin Ratio | Under-Layer % Solids | Max. Optical Density | Haze | Percent Wetness |
|---|---|---|---|---|---|
| 1-1 | 0.45:1 | 6.44% | 3.131 | 20.4 | Wedge 3 was 75% wet |
| 1-2 | 0.45:1 | 6.44% | 3.159 | 20.2 | Wedge 3 was 100% wet |
| 1-3 | 0.45:1 | 6.44% | 3.103 | 19.0 | Wedge 3 was 100% wet |
| 2-1 | 0.53:1 | 6.79% | 3.062 | 20.7 | Wedge 2 was 88% wet<br>Wedge 3 was 12% wet |
| 2-2 | 0.53:1 | 6.79% | 3.047 | 21.0 | Wedge 2 was 25% wet<br>Wedge 3 was 25% wet with banding |
| 3-1 | 0.58:1 | 7.00% | 3.002 | 22.1 | Wedge 2 was 75% wet<br>Wedge 3 was 12% wet |
| 3-2 | 0.58:1 | 7.00% | 3.073 | 23.7 | Wedge 2 was 88% wet<br>Wedge 3 was 25% wet |
| 4-1 | 0.45:1 | 6.44% | 3.111 | 19.5 | Wedge 3 was 75% wet |
| 4-2 | 0.45:1 | 6.44% | 3.055 | 20.0 | Wedge 2 was 25% wet<br>Wedge 3 was 12% wet |
| 5-1 | 0.53:1 | 6.79% | 3.122 | 21.3 | Wedge 2 was 12% wet<br>Wedge 3 was 12% wet |
| 5-2 | 0.53:1 | 6.79% | 3.092 | 23.7 | Wedge 3 was 25% wet<br>Wedge 3 was 12% wet |
| 6-1 | 0.62:1 | 7.14% | 3.130 | 24.0 | Wedge 2 was 75% wet<br>Wedge 3 was 12% wet |
| 6-2 | 0.62:1 | 7.14% | 3.121 | 20.0 | Wedge 1 was 100% wet<br>Wedge 2 was 12% wet with banding |
| 6-3 | 0.62:1 | 7.14% | 3.127 | 21.2 | Wedge 2 was 88% wet<br>Wedge 3 was 12% wet |
| 6-4 | 0.62:1 | 7.14% | 3.066 | 20.0 | Wedge 2 was 75% wet<br>Wedge 3 was 12% wet |
| 7-1 | 0.62:1 | 7.14% | 3.058 | 29.2 | Wedge 2 was 0-12% wet |
| 7-2 | 0.62:1 | 7.14% | 3.124 | 29.2 | Wedge 1 was 0-12% wet |
| 8-1 | 0.62:1 | 7.14% | 3.056 | 25.9 | Wedge 2 was 12% wet<br>Wedge 3 was 0-12% wet |
| 8-2 | 0.62:1 | 7.14% | 3.204 | 25.9 | Wedge 1 was 0-12% wet |
| 9-1 | 0.45:1 | 6.44% | 3.042 | 26.9 | Wedge 2 was 12% wet<br>Wedge 3 was 0-12% wet |
| 9-2 | 0.45:1 | 6.44% | 3.184 | 26.9 | Wedge 1 was 12% wet |

TABLE II

| ID | Under-Layer Mix Feed Rate (g/min) | Under-Layer Borax to Gelatin Wt. Ratio | Dry Under-Layer Coating Weight (g/m$^2$) | Estimated Boron Coverage in Dry Under-Layer (g/m$^2$) | Percent Wetness |
|---|---|---|---|---|---|
| 7-1 | 61.0 | 0.62:1 | 4.3 | 0.19-0.21 | Wedge 2 was 0-12% wet |
| 7-2 | 61.0 | 0.62:1 | 4.3 | 0.19-0.21 | Wedge 1 was 0-12% wet |
| 8-1 | 44.5 | 0.45:1 | 3.1 | 0.14-0.16 | Wedge 2 was 12% wet<br>Wedge 3 was 0-12% wet |
| 8-2 | 44.5 | 0.45:1 | 3.1 | 0.14-0.16 | Wedge 1 was 0-12% wet |
| 9-1 | 61.0 | 0.45:1 | 3.9 | 0.14-0.16 | Wedge 2 was 12% wet<br>Wedge 3 was 0-12% wet |
| 9-2 | 61.0 | 0.45:1 | 3.9 | 0.14-0.16 | Wedge 1 was 12% wet |

Example 10 (Comparative)

Preparation of Under-Layers

A mix was prepared at room temperature by mixing 533 g of a 15 wt % aqueous solution of poly(vinyl alcohol) (CELVOL® 203) and 1467 g of deionized water. To this mix, 4000 g of a 4 wt % aqueous solution of borax (sodium tetraborate decahydrate) was mixed. This mix was cooled to room temperature and held to allow disengagement of any gas bubbles prior to use. The ratio of borax to poly(vinyl alcohol) in the resulting under-layer coating mix was 66:33 by weight.

The under-layer coating mix was heated to 40° C. 23.2 g/min of the under-layer coating mix was applied continuously to room temperature polyethylene terephthalate webs, which were moving at a speed of 30.0 ft/min. The coated webs were dried continuously by moving past perforated plates through which room temperature air flowed. The pressure drops across the perforated plates were in the range of 0.8 to 3 in $H_2O$. The air dew point ranged from 7 to 13° C. The resulting dry under-layer coating weight was 0.67 g/m$^2$.

Preparation of Alumina Mixes

A nominal 20 wt % alumina mix was prepared at room temperature by mixing 94 g of a 22 wt % aqueous solution of nitric acid and 6706 g of deionized water. To this mix, 1700 g of alumina powder (DISPERAL® HP-14) was added over 30 min. The pH of the mix was adjusted to 3.25 by adding an additional 21 g of the nitric acid solution. The mix was heated to 80° C. and stirred for 30 min. The mix was cooled to room temperature and held for gas bubble disengagement prior to use. The cooled mix had a pH of 3.60.

A nominal 25 wt % alumina mix was prepared in a similar manner, using 135 g of the nitric acid solution in 6090 g deionized water, and 2075 g alumina powder. The pH of the mix was adjusted to 2.56 by adding an additional 39 g of the nitric acid solution. The mix was cooled to room temperature and held for gas bubble disengagement prior to use. The cooled mix had a pH of 3.40.

A nominal 30 wt % alumina mix was prepared in a similar manner, using 180 g of the nitric acid solution in 5420 g deionized water, and 2400 g alumina powder. The pH of the mix was adjusted to 2.17 by adding an additional 58 g of the nitric acid solution. The mix was cooled to room temperature and held for gas bubble disengagement prior to use. The cooled mix had a pH of 2.96.

Preparation of Image-Receiving Layer Coating Mixes

A nominal 18 wt % solids image-receiving coating mix was prepared at room temperature by adding 1432 g of a 10 wt % aqueous solution of poly(vinyl alcohol) (CELVOL® 540) and 202 g deionized water. To this mix, 8234 g of the nominal 20 wt % alumina mix and 133 g of a 10 wt % aqueous solution of nonyl phenol, glycidyl polyether (Surfactant 10G) was added. The mix was cooled to room temperature and held for gas bubble disengagement prior to use.

A nominal 22 wt % solids image receiving coating mix was prepared in a similar manner, using 1757 g of the poly(vinyl alcohol) solution, no deionized water, 8082 g of the nominal 25 wt % alumina mix, and 163 g of the polyether solution. The mix was cooled to room temperature and held for gas bubble disengagement prior to use.

A nominal 26 wt % solids image receiving coating mix was prepared in a similar manner, using 2030 g of the poly(vinyl alcohol) solution, no deionized water, 7782 g of the nominal 30 wt % alumina mix, and 188 g of the polyether solution. The mix was cooled to room temperature and held for gas bubble disengagement prior to use.

Preparation of Image-Receiving Layer Coated Films

The image-coating mixes were heated to 40° C. Each of the image-receiving coating mixes was coated onto the under-layer coated surface of a room temperature polyethylene terephthalate web, which was moving at a speed of 30.0 ft/min. A range of image-receiving coating mix feed rates were used to achieve a variety of image-receiving coating layer weights. The coated films were dried continuously by moving past perforated plates through which room temperature air flowed. The pressure drops across the perforated plates were in the range of 0.8 to 3 in $H_2O$. The air dew point ranged from 7 to 13° C. The resulting image-receiving layer coated weights are summarized in Table III.

Evaluation of Samples

The coated films were imaged with an EPSON® 7900 ink-jet printer using a Wasatch Raster Image Processor (RIP). A grey scale image was created by a combination of photo black, light black, light light black, magenta, light magenta, cyan, light cyan, and yellow EPSON® inks that were supplied with the printer. Samples were printed with a 17-step grey scale wedge having a maximum optical density of at least 2.8.

The optical density of each coated film was measured using a calibrated X-RITE® Model DTP 41 Spectrophotometer (X-Rite, Inc., Grandville, Mich.) in transmission mode.

The visual appearances of the coated films were rank-ordered according to the severity of their impingement patterning. A rank of "1" indicates the film with the least severe patterning, while the highest rank indicates the film with the most severe patterning.

Table III summarizes the analysis of the coated films. Films with low image-receiving layer coating weights exhibited puddling, while films with higher coating weights exhibited impingement patterning. Note that three of the samples exhibited no impingement patterning, while the impingement patterning of the remaining films were rank ordered from 4 to 9. At all coating weights, use of the coating mixes with 26 wt % solids exhibited less impingement patterning than those using mixes with 22 wt % solids, which in turn exhibited less impingement patterning than those using mixes with 18 wt % solids. The optical density for the sample made from the 26 wt % solids coating mix at a coating weight of 44.1 g/m$^2$ exhibited higher maximum optical densities than comparable coating weight samples made from lower solids coating mixes. In Table III, "IR Layer" refers to the Image-Receiving Layer.

TABLE III

| ID # | IR Layer* Coating Mix Feed Rate (g/min) | Nominal IR Layer Coating Mix % Solids | IR Layer Coating Weight (g/sq. m.) | Max. Optical Density | Puddle? | Impingement Patterning Ordinal Rank (1 = best, 9 = worst) |
|---|---|---|---|---|---|---|
| 18-1 | 113.3 | 18 | 22.4 | 3.437 | Yes | no patterning |
| 18-2 | 170.0 | 18 | 33.6 | 3.504 | Yes | 6 |
| 18-3 | 226.7 | 18 | 44.3 | 3.024 | No | 9 |
| 26-1 | 80.0 | 26 | 22.1 | 3.064 | Yes | no patterning |
| 26-2 | 119.9 | 26 | 33.0 | 2.883 | Yes | 4 |
| 26-3 | 159.9 | 26 | 44.1 | 3.227 | No | 7 |
| 22-1 | 92.4 | 22 | 21.8 | 2.356 | Yes | no patterning |
| 22-2 | 138.6 | 22 | 32.5 | 3.358 | Yes | 5 |
| 22-3 | 184.8 | 22 | 43.6 | 3.074 | No | 8 |

*IR Layer refers to the Image-Receiving Layer

Example 11 (Comparative)

Under-layer coating mixes were prepared according to the procedure of Example 10, using either an EASTMAN AQ29® aqueous sulfonated polyester dispersion or an aqueous mixture of CELVOL® 203 poly(vinyl alcohol). The weight ratio of polymer to borax in all under-layers was targeted to be 67:33.

Under-layers were coated using a 4.5 mil coating gap onto either uncoated ("raw") poly(ethylene terephthalate) (PET) substrates or onto PET substrates having primer and subbing layers ("subbed"), as described in U.S. Provisional Pat. No. 61/391,255, filed Oct. 8, 2010, which is hereby incorporated by reference in its entirety. The dry coating weights are indicated in Table IV.

Image-receiving coating mixes where prepared similar to the procedure of Example 1, with the following changes. A 20% solution of boehmite alumina was used; the pH of the alumina mix was adjusted to 3.25; the boehmite alumina to poly(vinyl alcohol) ratio was 94:6; and no surfactant was used. Image-receiving layers were coated using either 12 mil or 14 mil coating gaps. The dry coating weighs are indicated in Table IV.

The mud-cracking of each coated film was visually assessed. Film haze (%) was measured in accord with ASTM D 1003 by conventional means using a HAZE-GARD PLUS Hazemeter (BYK-Gardner, Columbia, Md.).

As shown in Table IV, the transparent coated films prepared using the sulfonated polyester under-layers exhibited worse mud-cracking and haze than the films prepared using the poly(vinyl alcohol) under-layers. The only films that exhibited no mud-cracking were films comprising poly(vinyl alcohol).

TABLE IV

| Substrate Raw or Subbed | Under-Layer Resin | Under-Layer Dry Coating Weight (g/sq. m) | Image-Receiving Layer Dry Coating Weight (g/sq. m) | Percent Haze | Visual Appearance |
|---|---|---|---|---|---|
| Raw | CELVOL | 1.57 | 46.9 | 18.5 | No Mud Cracking |
| Raw | AQ | 1.46 | 46.9 | 20.6 | Poor Appearance |
| Raw | CELVOL | 1.56 | 51.4 | 20.2 | Poor Appearance |

TABLE IV-continued

| Substrate Raw or Subbed | Under-Layer Resin | Under-Layer Dry Coating Weight (g/sq. m) | Image-Receiving Layer Dry Coating Weight (g/sq. m) | Percent Haze | Visual Appearance |
|---|---|---|---|---|---|
| Raw | AQ | 1.36 | 51.4 | 21.1 | Very Poor Appearance |
| Subbed | CELVOL | 2.17 | 47.9 | 14.6 | No Mud Cracking |
| Subbed | AQ | 1.44 | 47.9 | 17.1 | Very Poor Appearance |

Example 12

Preparation of Comparative Poly(Vinyl Alcohol) Under-Layer Coating Mixes

A mix was prepared at room temperature by mixing 267 g of a 15 wt % aqueous solution of poly(vinyl alcohol) (CELVOL® 203) and 873 g of deionized water. To this mix, 1860 g of a 4 wt % aqueous solution of borax (sodium tetraborate decahydrate) was mixed. This mix was cooled to room temperature and held to allow disengagement of any gas bubbles prior to use. The ratio of borax to poly(vinyl alcohol) in the resulting under-layer coating mix was 66:33 by weight.

A second mix was similarly prepared using 200 g of the poly(vinyl alcohol) solution, 707 g of the deionized water, and 2093 g of the borax solution. The ratio of borax to poly (vinyl alcohol) in the resulting under-layer coating mix was 75:25 by weight.

Preparation of Gelatin Under-Layer Coating Mix

To a mixing vessel, 4793 g of deionized water was introduced. 360 g of gelatin was added to the agitated vessel and allowed to swell. This mix was heated to 60° C. and held until the gelatin was fully dissolved. The mix was then cooled to 50° C. To this mix, 162 g of borax (sodium tetraborate decahydrate) was added and mixed until the borax was fully dissolved. To this mix, 562 g of an aqueous solution of 3.2 wt % sulfonated polystyrene (VERSA-TL® 502, AkzoNobel) and 0.2 wt % microbiocide (KATHON® LX, Dow) was added and mixed until homogeneous. The mix was then cooled to 40° C. 123 g of a 10 wt % aqueous solution of nonyl phenol, glycidyl polyether (Surfactant 10G) was then added and mixed until homogeneous. This mix was cooled to room temperature and held to allow disengagement of any gas bubbles prior to use. The ratio of borax to gelatin in the resulting under-layer coating mix was 0.45:1 by weight.

Preparation of Under-Layer Coated Webs

The under-layer coating mixes were heated to 40° C. Each of the under-layer coating mixes was applied continuously to room temperature polyethylene terephthalate webs, which were moving at a speed of 30.0 ft/min. A range of under-layer coating mix feed rates were used to achieve a variety of under-layer coating weights. The coated webs were dried continuously by moving past perforated plates through which room temperature air flowed. The pressure drop across the perforated plates was 0.8 in $H_2O$. The air dew point ranged from 7 to 13° C. The resulting dry under-layer coating weights are summarized in Table V.

Preparation of Alumina Mix

An alumina mix was prepared at room temperature by mixing 310 g of a 22 wt % aqueous solution of nitric acid and 7740 g of deionized water. To this mix, 3450 g of alumina powder (DISPERAL® HP-14) was added over 30 min. The pH of the mix was adjusted to 2.17 by adding an additional 15 g of the nitric acid solution. The mix was heated to 80° C. and stirred for 30 min. The mix was cooled to room temperature and held for gas bubble disengagement prior to use. The cooled mix had a pH of 2.73.

Preparation of Image-Receiving Layer Coating Mix

An image-receiving coating mix was prepared at room temperature by introducing 2801 g of a 10 wt % aqueous solution of poly(vinyl alcohol) (CELVOL® 540) into a mixing vessel and agitating. To this mix, 10739 g of the alumina mix and 259 g of a 10 wt % aqueous solution of nonyl phenol, glycidyl polyether (Surfactant 10G) was added. The mix was cooled to room temperature and held for gas bubble disengagement prior to use.

Preparation of Image-Receiving Layer Coated Films

The image-coating mixes were heated to 40° C. Each of the image-receiving coating mixes was coated onto the under-layer coated surface of a room temperature polyethylene terephthalate web, which was moving at a speed of 30.0 ft/min. A range of image-receiving coating mix feed rates were used to achieve a variety of image-receiving coating layer weights. The coated films were dried continuously by moving past perforated plates through which room temperature air flowed. The pressure drop across the perforated plates was 0.8 in $H_2O$. The air dew point ranged from 7 to 13° C. The resulting image-receiving layer coated weights are summarized in Table V.

Evaluation of Samples

The coated films were imaged with an EPSON® 7900 ink-jet printer using a Wasatch Raster Image Processor (RIP). A grey scale image was created by a combination of photo black, light black, light light black, magenta, light magenta, cyan, light cyan, and yellow EPSON® inks that were supplied with the printer. Samples were printed with a 17-step grey scale wedge having a maximum optical density of at least 2.8.

The optical density of each coated film was measured using a calibrated X-RITE® Model DTP 41 Spectrophotometer (X-Rite, Inc., Grandville, Mich.) in transmission mode. Each coated film was also visually inspected for the presence of ink puddling and for formation of impingement patterns after drying. No mud cracking was seen in any of the dried films.

Table V summarizes the analysis of the coated films. Comparative samples A-D used poly(vinyl alcohol) in the under-layer. Comparative samples A and C exhibited puddling after drying, while comparative samples B and D exhibited impingement patterning.

By contrast, samples E-H were free of puddling and impingement patterning. In particular, samples F and H demonstrate the ability to produce a transparent film with optical density greater than about 2.9 with an image-receiving layer coating weight of at least 40 g/m$^2$, where the film is free of puddling, impingement patterning, and mud cracking.

TABLE V

| ID # | IR Layer Coating Mix Feed Rate (g/min) | IR Layer Coating Weight (g/sq. m.) | Under Layer Resin | Under Layer Borax to Resin Ratio | Nominal Under Layer % solids | Under Layer Mix Feed Rate (g/min) | Under Layer Coating Weight (g/sq. m.) | Max. Optical Density | Puddle? | Impingement Patterning? |
|---|---|---|---|---|---|---|---|---|---|---|
| A | 109.0 | 30.4 | PVA | 66:33 | 4.0 | 31.3 | 0.96 | 3.226 | Yes | No |
| B | 145.4 | 40.1 | PVA | 66:33 | 4.0 | 31.3 | 0.96 | 3.116 | No | Yes |
| C | 109.0 | 30.5 | PVA | 75:25 | 4.0 | 31.3 | 0.97 | 3.319 | Yes | No |
| D | 145.4 | 40.5 | PVA | 75:25 | 4.0 | 31.3 | 0.97 | 3.197 | No | Yes |
| E | 109.0 | 30.3 | Gelatin | 0.45:1 | 9.2 | 28.8 | 2.90 | 3.233 | No | No |
| F | 145.4 | 40.3 | Gelatin | 0.45:1 | 9.2 | 28.8 | 2.90 | 3.111 | No | No |
| G | 109.0 | 30.5 | Gelatin | 0.45:1 | 9.2 | 41.3 | 4.15 | 3.102 | No | No |
| H | 145.4 | 41.0 | Gelatin | 0.45:1 | 9.2 | 41.3 | 4.15 | 2.939 | No | No |

For Table V, the IR Layer refer to the Image-Receiving Layer

Example 13

Preparation of Under-Layer Coating Mix

To a mixing vessel, 998 parts by weight of demineralized water was introduced. 78 parts of gelatin was added to the agitated vessel and allowed to swell. This mix was heated to 60° C. The mix was then cooled to 46° C. To this mix, 35 parts of borax (sodium tetraborate decahydrate) was added and held for 15 min. To this mix, 120 parts of an aqueous solution of 32.5 wt % sulfonated polystyrene (VERSA-TL® 502, AkzoNobel) and 0.2 wt % microbiocide (KATHON® LX, Dow) was added and mixed until homogeneous. The mix was then cooled to 40° C. 26 parts of a 10 wt % aqueous solution of nonyl phenol, glycidyl polyether (Surfactant 10G) and 39 parts demineralized water were then added and mixed until homogeneous. This mix was cooled to room temperature and held to allow disengagement of any gas bubbles prior to use. The weight ratio of borax to gelatin in the resulting under-layer coating mix was 0.45:1.

Preparation of Poly(Vinyl Alcohol) Mix

A poly(vinyl alcohol) mix was prepared at room temperature by adding 7 parts by weight of poly(vinyl alcohol) (CELVOL® 540) to a mixing vessel containing 93 parts of dimineralized water over 10 min with 500 rpm agitation. This mixture was heated to 85° C. and agitated for 30 minutes. The mixture was then allowed to cool to room temperature. Dimineralized water was added to make up for water lost due to evaporation.

Preparation of Alumina Mix

An alumina mix was prepared at room temperature by mixing 75.4 parts by weight of a 9.7 wt % aqueous solution of nitric acid and 764.6 parts of demineralized water. To this mix, 360 parts of alumina powder (DISPERAL® HP-14) was added over 30 min. The mix was heated to 80° C. and stirred for 30 min. The mix was cooled to room temperature and held for gas bubble disengagement prior to use.

Preparation of Image-Receiving Layer Coating Mix

An image-receiving coating mix was prepared at room temperature by introducing 470 parts of the alumina mix into a mixing vessel and agitating. The mix was heated to 40° C. To this mix, 175 parts by weight of the 7 wt % aqueous solution of poly(vinyl alcohol) (CELVOL® 540) and 11 parts of a 10 wt % aqueous solution of nonyl phenol, glycidyl polyether (Surfactant 10G) were added. After 30 min, the resulting mixture was cooled to room temperature and held for gas bubble disengagement prior to use.

Preparation of the Coated Film

The under-layer coating mix was applied to a continuously moving polyethylene terephthalate web. The coated web was dried continuously by moving past perforated plates through which room temperature air flowed. The pressure drop across the perforated plates was in the range of 0.2 to 5 in $H_2O$. The air dew point was in the range of −4 to 12° C. The under-layer dry coating weight was 5.4 g/m$^2$.

The image-receiving layer coating mix was applied to the under-layer coating and dried in a second pass. The coated film was dried continuously by moving past perforated plates through which room temperature air flowed. The pressure drop across the perforated plates was in the range of 0.2 to 5 in $H_2O$. The air dew point was in the range of −4 to 12° C. The image-receiving layer dry coating weight was 48.2 g/m$^2$.

No mud cracking or impingement patterning was seen in the coated film. The boron coverage in the coated film was estimated by the method of Example 9 to be 0.16-0.17 g/m$^2$.

Evaluation of Coated Film

Samples of the coated film were evaluated at three sets of temperatures and humidities after equilibrating at these conditions for at least 16 hrs prior to printing. The coated film samples were imaged with an EPSON® 4900 ink-jet printer using a Wasatch Raster Image Processor (RIP). A grey scale image was created by a combination of photo black, light black, light light black, magenta, light magenta, cyan, light cyan, and yellow EPSON® inks that were supplied with the printer. Samples were printed with a 17-step grey scale wedge having a maximum optical density of at least 2.8. as measured by a calibrated X-RITE® Model DTP 41 Spectrophotometer (X-Rite, Inc., Grandville, Mich.) in transmission mode. Immediately after each film sample exited the printer, the ink-jet image was turned over and placed over a piece of white paper. The fraction of each wedge that was wet was recorded by sequential wedge number, with wedge 1 being the wedge having the maximum optical density and wedge 17 being the wedge with the minimum optical density. In general, the higher number wedges dried before the lowest number wedges.

A measure of wetness ("wetness value") was constructed by taking the largest wedge number for the set of completely wet wedges and adding to it the fractional wetness of the adjacent wedge with the next higher wedge number. For example, if wedges 1 and 2 were completely wet and wedge 3 was 25% wet, the wetness value would be 2.25. Or if no wedges were completely wet, but wedge 1 was 75% wet, the wetness value would be 0.75.

Table VI summarizes the ink-drying results for the coated film samples. The coated film sample printed under the lowest humidity conditions attained a wetness score of 0; that printed under intermediate humidity conditions attained a wetness score of 0.125, and that printed under the highest humidity conditions attained a wetness score of 0.25-0.5.

The invention has been described in detail with reference to particular embodiments, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

TABLE VI

| ID | Printing Temperature | Printing Relative Humidity | Maximum Optical Density | Wetness Value |
|---|---|---|---|---|
| 13-1 | 20° C. | 86% | 2.887 | 0.25-0.50 |
| 13-2 | 24° C. | 47% | 2.845 | 0 |
| 13-3 | 30° C. | 73% | 2.932 | 0.125 |

The invention claimed is:

1. A transparent ink-jet recording film, comprising:

a transparent substrate;

at least one under-layer disposed on said substrate, said under-layer consisting essentially of gelatin and at least one borate or borate derivative, said at least one under-layer comprising at least about 0.1 g/m$^2$ boron atoms on a dry coating basis; and at least one image-receiving layer disposed on said at least one under-layer, said image-receiving layer comprising at least one water soluble or water dispersible polymer, and at least one inorganic particle.

2. The transparent ink-jet recording film according to claim 1, wherein said under-layer comprises at least about 0.16 g/m$^2$ boron atoms on a dry coating basis.

3. The transparent ink-jet recording film according to claim 1, wherein said under-layer comprises from about 0.16 g/m$^2$ to about 0.21 g/m$^2$ boron atoms on a dry coating basis.

4. The transparent ink-jet recording film according to claim 1, wherein said under-layer comprises at least about 0.19 g/m$^2$ boron atoms on a dry coating basis.

5. The transparent ink-jet recording film according to claim 1, wherein said under-layer comprises from about 0.19 g/m$^2$ to about 0.21 g/m$^2$ boron atoms on a dry coating basis.

6. The transparent ink-jet recording film according to claim 1, wherein said at least one under-layer comprises a dry coating weight of at least about 4.3 g/m$^2$.

7. The transparent ink-jet recording film according to claim 1, wherein said at least one borate or borate derivative comprises at least one hydrate of sodium tetraborate.

8. The transparent ink-jet recording film according to claim 1, wherein said at least one borate or borate derivative comprises sodium tetraborate decahydrate.

9. The transparent ink-jet recording film according to claim 1, wherein said at least one water soluble or water dispersible polymer comprises poly(vinyl alcohol).

10. The transparent ink-jet recording film according to claim 1, wherein said at least one inorganic particle comprises boehmite alumina.

11. The transparent ink-jet recording film according to claim 1, wherein said image-receiving layer further comprises at least one surfactant.

12. The transparent ink-jet recording film according to claim 1, wherein the film exhibits no visually discernable impingement patterning or mud-cracking.

13. The transparent ink-jet recording film according to claim 12, wherein said image-receiving layer comprises a dry coating weight of at least about 46 g/m$^2$.

14. The transparent ink-jet recording film according to claim 13, wherein the film exhibits no ink puddling when imaged with an ink-jet printer at optical densities of at least 2.8.

15. The transparent ink-jet recording film according to claim 13, wherein the film exhibits percent wetness below about 25% when imaged at 57-58% relative humidity with an ink-jet printer at optical densities of at least 3.0.

16. The transparent ink-jet recording film according to claim 13, wherein the film exhibits wetness values below about 0.50 when imaged at 86% relative humidity with an ink-jet printer at optical densities of at least 2.8.

17. The transparent ink-jet recording film according to claim 13, wherein the film exhibits wetness values below about 0.25 when imaged at 73% relative humidity with an ink-jet printer at optical densities of at least 2.8.

* * * * *